United States Patent [19]

Mahr et al.

[11] 3,980,286

[45] Sept. 14, 1976

[54] TUYERE FEED LINES

[75] Inventors: René N. Mahr, Howald-Hesperange, Luxemburg; Ernest P. Küntziger, Assenede, Belgium

[73] Assignee: S.A. des Anciens Etablissements Paul Wurth, Luxembourg, Luxemburg

[22] Filed: July 17, 1974

[21] Appl. No.: 489,459

[30] Foreign Application Priority Data

July 30, 1973 Luxemburg ..... 68126

[52] U.S. Cl. ..... 266/270

[51] Int. Cl.[2] ..... C21B 7/16

[58] Field of Search ..... 110/182.5; 122/6.6; 266/29, 30, 41, 270

[56] References Cited

UNITED STATES PATENTS

| | | | |
|---|---|---|---|
| 199,134 | 1/1878 | Witherbee | 110/182.5 |
| 278,685 | 6/1883 | Cremer | 122/6.6 |
| 3,281,135 | 10/1966 | Boron | 266/30 |
| 3,425,677 | 2/1969 | White | 266/41 X |
| 3,558,119 | 1/1971 | Demalander | 266/41 |

FOREIGN PATENTS OR APPLICATIONS

| | | | |
|---|---|---|---|
| 235,316 | 6/1925 | United Kingdom | 266/41 |
| 142,658 | 12/1960 | U.S.S.R. | 122/6.6 |

OTHER PUBLICATIONS

Publication: Metallurgist No. 12; Dec., 1963; author: Kordabnev.

*Primary Examiner*—Roy Lake
*Assistant Examiner*—Paul A. Bell

[57] ABSTRACT

A tuyere stock wherein the blast nozzle, which is the downstream section of the stock, is rigidly coupled to the blast tuyere through which the preheated gas is injected into the furnace. The blast nozzle-blast tuyere assembly and a cooling jacket, which is mounted in the furnace wall about the aperture through which the tuyere stock passes, cooperate to define an articulated connection whereby thermally induced distortions of the various components of the stock may be accommodated without interrupting the sealing efficiency of the connection.

14 Claims, 3 Drawing Figures

TUYERE FEED LINES

BACKGROUND OF THE INVENTION

1. Field of the Invention

The present invention relates to the delivery of preheated gas into an enclosure and particularly to shaft furnaces. More specifically, this invention is directed to improved tuyere feed lines and particularly to blast furnace tuyere stocks. Accordingly, the general objects of the present invention are to provide novel and improved methods and apparatus of such character.

2. Description of the Prior Art

In shaft furnaces, and particularly in blast furnaces employed in the production of pig iron, preheated air is injected into the furnace via a plurality fo tuyere injection nozzles located about the periphery of the furnace. These injection nozzles are connected to a common supply pipe, located circumferentially of the furnace, by means of feed conduits which are known in the art as tuyere feed stocks. Prior art tuyere feed stocks generally consist of a number of tubular members provided with a refractory lining and connected to the supply pipe for the preheated gas by means of flanges.

In the interest of enhancing production efficiency, there has in recent years been a trend toward increasing blast furnace capacity. Increased production capacity has, to some extent, been achieved through increasing furnace pressure and temperature. Also in the interest of enhanced production efficiency, minimization of furnace shut-down time is desired and, in fact, design objectives are to enable operational periods of up to several months without the necessity of performing maintenance procedures. Accordingly, the components of the tuyere stocks, and particularly the blast nozzles and blast tuyeres which are positioned at the downstream end of the stocks adjacent the furnace wall, must be efficiently protected against the deleterious effects of hot air temperatures. To this end, the blast tuyeres, which actually project into the furnace, are typically surrounded by multi-compartmented cooling chambers. Additionally, the blast tuyeres and the blast nozzles, which are located immediately upstream of the blast tuyeres in the direction of preheated air flow, are protected by a coating of refractory material over as great a portion of their lengths as possible.

In order to compensate for and/or balance out tolerances arising during manufacture and installation, inaccuracies occurring during assembly and thermal expansion which takes place during operation, either all or certain sections of the tuyere stocks are interconnected by means of ball and socket joints, expansion bellows, pivot compensators or similar devices. Thus, by way of example, U.S. Pat. No. 3,662,696, the disclosure of which is incorporated herein by reference, describes a tuyere stock in which the joints between the individual sections of a tuyere feed line are comprised of universal coupling compensators. The construction of the patented tuyere stock offers the advantage that the various deformations in the individual sections of the feed line caused by the temperature of the gas flowing therethrough are balanced out by means of universal joints and bellows which have a limited number of undulations and which do not require the use of ball-and-socket joints. The blast nozzle of the tuyere stock of U.S. Pat. No. 3,662,696 if firmly pressed against the blast tuyere, mounted in the blast furnace wall, by means of clamping devices; the contact between the blast nozzle and the blast tuyere being in the form of a spherical sealing surface in the interest of absorbing any relative displacements between the blast nozzle and the blast tuyere.

Copending U.S. Pat. application Ser. No. 339,117 discloses a tuyere stock mount including a guide bar arrangement which prevents the blast nozzle from moving out of its central position with relation to the blast tuyere. Thus, the apparatus of U.S. Application No. 339,117 permits establishment of a rigid connection between the blast nozzle and blast tuyere. In the apparatus of copending U.S. Application 339,117 a sliding surface is provided on the bottom side of the blast nozzle while the wall of the blast furnace is provided with a guide means which cooperates with the sliding surface on the nozzle. This structure cooperates to hold the blast nozzle in the proper operating position and, if the nozzle should for any reason attempt to move relative to the blast tuyere, the nozzle is at all times kept in a central and predominantly horizontal position with respect to the blast tuyere. Additionally, clamp means are provided for pressing the blast nozzle and the blast tuyere toward the axis of the furnace and the individual parts of the tuyere stock are flexibly interconnected in such a manner that compensation for thermal expansions and constructional deviations is provided even though the lower part of the tuyere stock remains in the same position as required by the cooperation between the sliding surface of the blast nozzle and the furnace wall. The flexible interconnection of the components of the tuyere feed lines of application Ser. No. 339,117 are comprised of two universal couplings each having two diametrically opposed arms provided with slots in which the bolts of the connecting Cardan ring can slide in the longitudinal direction.

To briefly summarize the state of the art prior to the present invention, two general types of tuyere feed lines were known. A first prior art tuyere stock employs a form of pivot connection between the blast nozzle and blast tuyere whereas the other general type of prior art tuyere feed stock is characterized by the maintenance of a fixed relative position between the blast nozzle and blast tuyere. Both of these prior art approaches to the delivery of preheated gas to the interior of a shaft furnace have certain disadvantages.

Continuing with a discussion of tuyere feed lines of the type of U.S. Pat. No. 3,662,696, there is of necessity a discontinuity in the refractory lining of the blast nozzle in the vicinity of the pivot connection to the stationary blast tuyere; this pivot connection often consisting of a stainless steel ball segment as required by the high temperatures of the operating environment. In the interest of improving the operational life of this metal-on-metal joint in the face of increasing furnace temperatures, cooling means have been provided. The net effect, however, is to preclude the use of a refractory lining on the blast tuyere since such a lining would readily be eroded and destroyed as a result of the turbulence in the flowing hot air produced by the necessarily present joint gap. On the other hand, the thermal losses at the blast tuyere and the pivot joint of the blast nozzle are incompatible with the desire to increase blast temperatures; i.e., the desire to increase the temperature of the gas provided through the tuyere feed line as the temperatures within the furnace are increased. Similarly, the increases in back pressure; i.e., furnace top pressure; must be met by higher blast pressures on the blast tuyere. Higher blast pressures and gas temperatures at the blast tuyere produce operating conditions which have a deleterious effect on the operational reliability, over long periods of time, of the pivot connection of U.S. Pat. No. 3,662,696. In the patented apparatus, should withdrawal and replacement of a blast tuyere be dictated either by a component failure or the desire to perform preventative maintenance, the blast nozzle has to be disconnected from the tuyere stock and removed and thereafter the blast tuyere dislodged from its seat in the furnace wall by means of special equipment such as jolt-ramming or hammer machines. Considering the large number of blast tuyeres in a modern blast furnace, this procedure is rather time-consuming and therefore in contradiction to the desire for very short operating interruptions of the furnace.

In the case of tuyere feed lines characterized by fixed relative positioning of the blast nozzle and blast tuyere, a rather accurate adjustment of the blast nozzle/blast tuyere unit with reference to the tuyere arc cooler is required thereby demanding a special design of the various tuyere feed line elements. Nevertheless, this second general type of prior art tuyere stock is characterized by many of the disadvantages inherent to the type of stock wherein a ball joint is provided between the blast nozzle and blast tuyere.

SUMMARY OF THE INVENTION

The present invention overcomes the above briefly discussed and other deficiencies and disadvantages of the prior art by providing a novel and improved tuyere feed line which incorporates the desirable features of the above described prior art devices of like character. Thus, in accordance with the present invention, a tuyere stock for shaft furnaces is provided which includes a plurality of serially coupled pipe sections. These pipe sections terminate, adjacent the furnace wall, at a blast nozzle structure which is sluable with respect to the furnace wall. The blast nozzle structure comprises a blast tuyere which projects into the furnace and which is coupled to the pipe sections of the stock by means of a blast nozzle. The blast nozzle and blast tuyere are rigidly connected together to define a unit which is coupled against a tuyere arc cooler by means of a "hinged" or articulated type of joint.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

Figure 1:
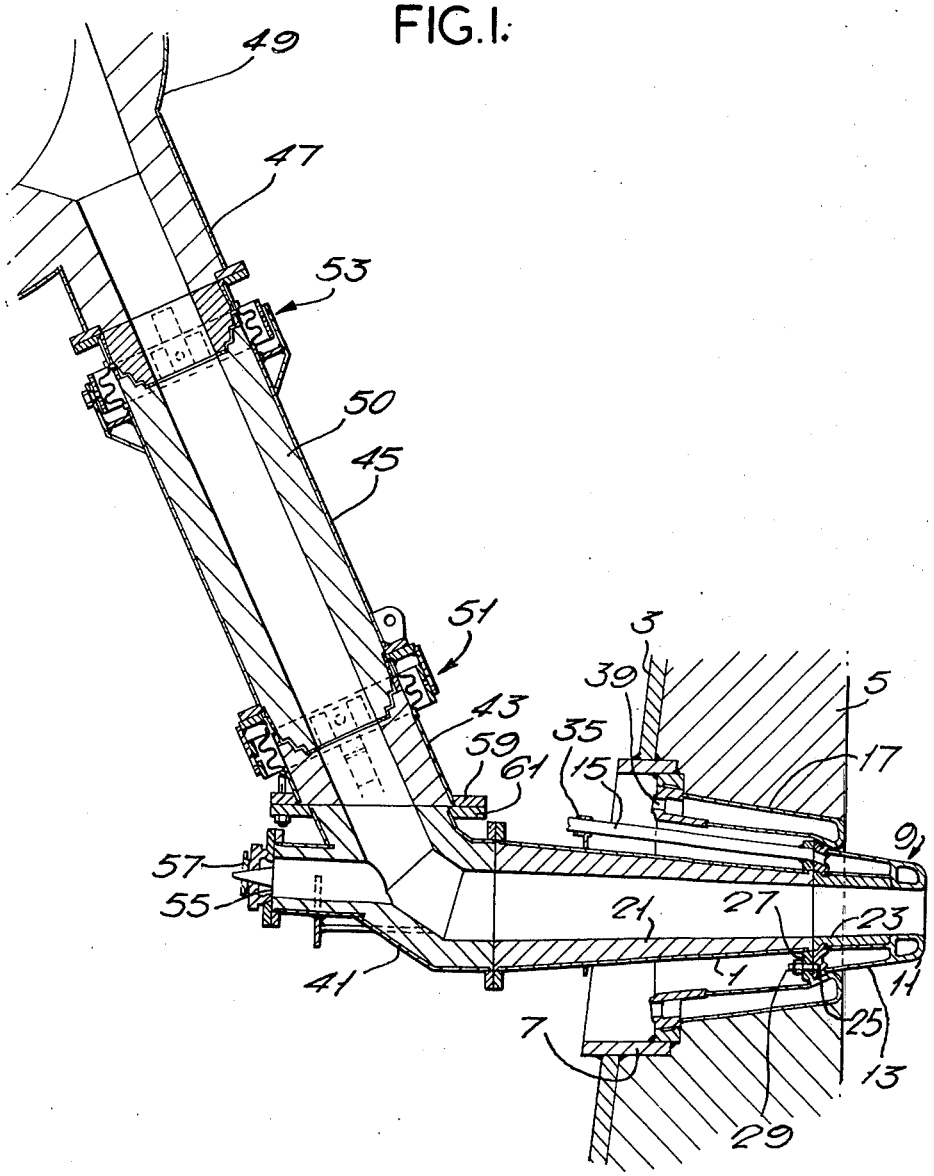
FIG. 1 is a cross-sectional, side elevation view of a first embodiment of a tuyere stock in accordance with the present invention.
Figure 2:
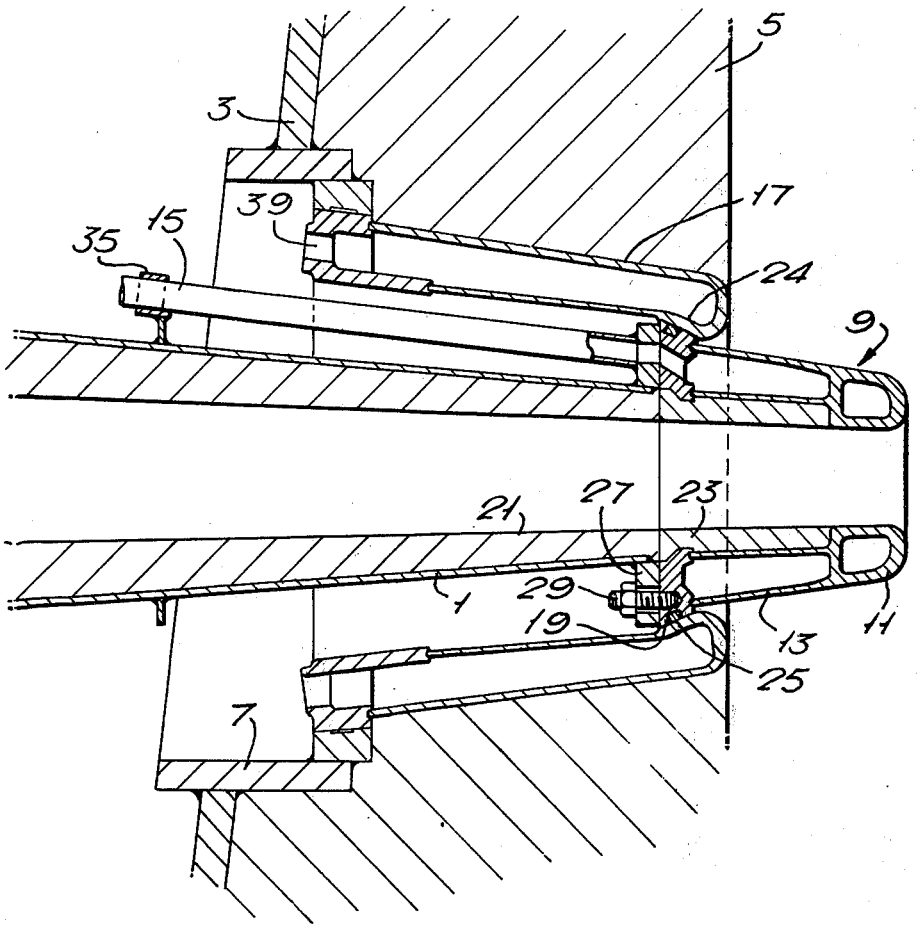
FIG. 2 is an enlarged sectional view of the blast nozzle and blast tuyere of the embodiment of FIG. 1.

DESCRIPTION OF THE PREFERRED EMBODIMENTS:

Referring now jointly to FIGS. 1 and 2, a tuyere stock is provided, at its downstream or discharge end, with a blast nozzle 1 and a blast tuyere 9. The blast nozzle 1 passes through the casing 3 and refractory lining 5 of the wall of a blast furnace; penetration of the furnace wall being via a tuyere block 7 and a tuyere arc cooler 17. In accordance with the present invention, and in counter-distinction to the prior art, the blast nozzle 1 is flexibly mounted with respect to the furnace wall and rigidly connected to the blast tuyere 9 which projects into the furnace. In the embodiment of FIGS. 1 and 2, as will be described in detail below, the flexible mounting of the blast nozzle to the furnace wall is achieved by intervention of the blast tuyere.

The blast tuyere 9 is cooled, in the conventional manner, by means of circulating a suitable coolant such as water through two sectional chambers. The first to these sectional chambers cools the nose or tip portion 11 while the other chamber cools the body portion 13 of blast tuyere 9. A coolant supply line for blast tuyere 9 is indicated at 15. As will be obvious to those skilled in the art, the blast tuyere 9 may be provided with only a single cooling chamber or may have more than two passages for coolant provided therein.

Spring clamp means, omitted from the drawing in the interest of facilitating understanding of the invention, operates on the unit bend 41 of the tuyere stock to urge blast nozzle 1 toward the furnace axis thereby firmly press the blast tuyere 9 against the tuyere arc cooler 17. A liquid coolant will typically be circulated through arc cooler 17 with the coolant being delivered thereto via orifice 39. The tuyere arc cooler 17 is mounted on the tuyere block 7 and fixed in position in the furnace wall in the conventional manner.

The present invention is characterized by the blast nozzle 1 and the blast tuyere 9 being rigidly interconnected and, additionally, by the establishment of a "hinged" connection between the blast nozzle 1 and the furnace wall. This "hinged" or articulated connection is accomplished by flexibly coupling the unitary blast nozzle/blast tuyere structure to the tuyere arc cooler 17.

Referring specifically to FIG. 2, the tuyere arc cooler 17 is provided with an arcuate sealing surface defined by an inward buckling of a portion 24 of the cooler wall towards the normal axis of the blast nozzle. The generally concave wall section 24 of tuyere arc cooler 17 cooperates with a complementary surface 19 formed on the periphery of the check ring which defines the upstream end of blast tuyere 9. Thus, the hinged connection between the blast nozzle and the furnace wall is achieved by intervention of the blast tuyere 9. The conicity of lines tangent to the center line of the spherical joint or contact region between surfaces 19 and 24 is conspicuously superior to that of the connection between the blast tuyere and the tuyere arc cooler in accordance with the prior art. Whereas in the prior art the conicity of the blast tuyere seating in the tuyere arc cooler has been as small as possible, in the range of 10°–15°, in the interest of wedging the blast tuyere into the tuyere arc cooler, in accordance with the present invention the conicity will be 50°–60°. Restated, in accordance with the present invention the acute angle of the cone formed at the axis of the blast tuyere 9 by lines tangent to the center line of the spherical zone of the seat between the peripheral surface 19 on the check ring of blast tuyere 9 and wall portion 24 of arc cooler 17 is preferably in the range of 50°–60°.

The blast nozzle 1 and blast tuyere 9 are simply and rapidly connected to one another by providing a flange 27 at the downstream end of blast nozzle 1. A plurality of stud bolts 29 pass through flange 27 and engage the check ring at the upstream end of blast tuyere 9. The flange 27 of the blast nozzle 1 and the blast tuyere 9 are thus bolted to one another by means of the stud bolts 29. The contact surface of the blast nozzle to the blast tuyere may be furnished with a gasket if deemed necessary of desirable. As will be obvious to those skilled in the art, the blast tuyere 9 and nozzle 1 may be interconnected in a manner different from that shown; the technique depicted in FIG. 2, however, having the advantages of affording uncomplicated structure which is easy to assemble.

Figure 3:
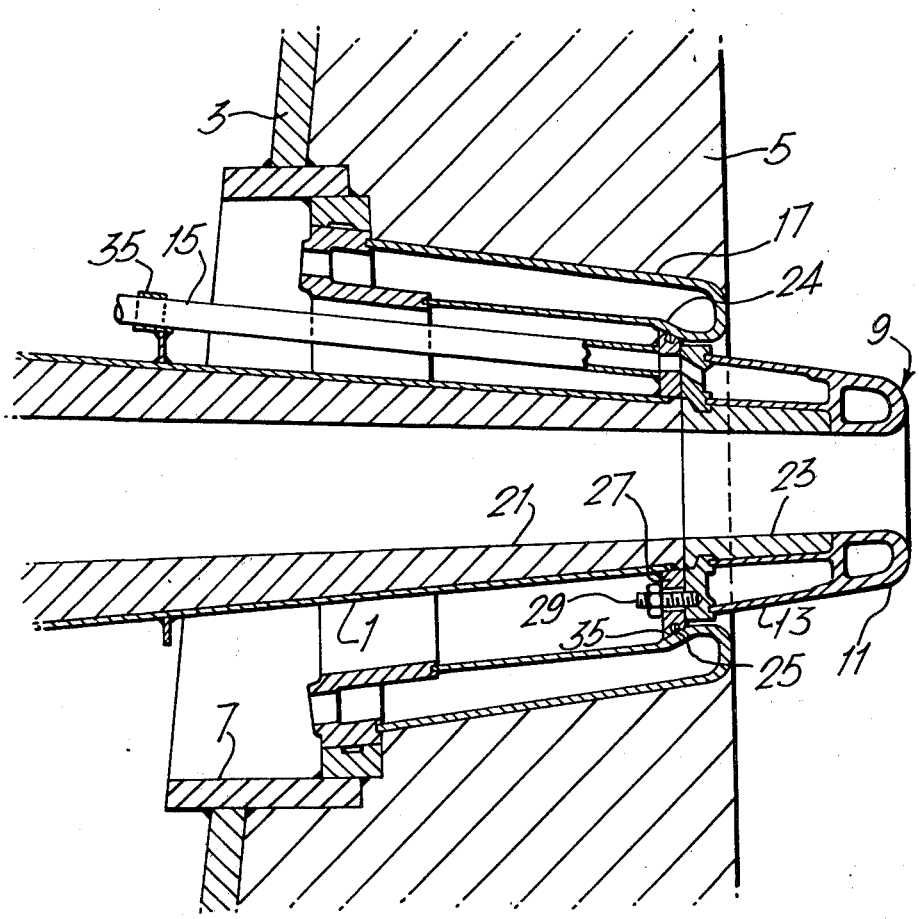
FIG. 3 is a view, similar to that of FIG. 3, depicting a second embodiment of a tuyere stock in accordance with the invention.

Referring now to FIG. 3, in accordance with a second embodiment of the present invention the hinged connection between the tuyere arc cooler 17 and the rigid unitary blast nozzle/blast tuyere assembly is achieved by intervention of the blast nozzle. As in the FIG. 2 embodiment, the tuyere arc cooler is provided with a wall portion 24 which extends inwardly toward the normal axis of the blast nozzle 1. The wall surface 24 of the arc cooler cooperates, in the manner to be described below, with a sealing surface provided on the periphery of the flange 27 located at the downstream end of the blast nozzle 1 so as to define a pivot connection.

Continuing with a description of FIG. 3, the blast nozzle 1 passes through the casing 3 and the refractory lining 5 of the blast furnace wall via the tuyere block 7 and the tuyere arc cooler 17. The blast tuyere 9, which is connected to the downstream end of blast nozzle 1 by means of stud bolts 29 in the manner described above in the discussion of FIG. 2, is comprised of a nose portion 11 and a body portion 13; each portion of the blast tuyere being provided with a cooling chamber. Coolant is furnished to the blast tuyere cooling chambers via conduits such as conduit 15.

The flange 27 at the downstream end of blast nozzle 1, in addition to providing for the rigid interconnection of the blast nozzle and blast tuyere, performs a supplemental function. The peripheral side 35 of flange 27 is shaped so that it will cooperate with the concave wall portion 24 of the tuyere arc cooler 17. It may thus be seen that the hinged or articulated connection between the rigid unitary blast nozzle/blast tuyere assembly and the tuyere arc cooler 17 is, in the FIG. 3 embodiment, realized by intervention of the blast nozzle 1.

As in the embodiment of FIGS. 1 and 2, in the FIG. 3 arrangement the region of contact between the peripheral side 35 of flange 37 and wall portion 24 of the arc cooler 17 is advantageously spherical and the conicity; i.e., the acute angle of the cone formed at the axis of the blast tuyere by lines tangent to the center line of the spherical zone of the seat between elements 35 and 24; will be in the range of 50°–60°.

The hinged connection between the rigid unitary blast nozzle 1/blast tuyere 9 assembly and the tuyere arc cooler 17, in addition to overcoming the disadvantages of the prior art as discussed above, provides in the case of both disclosed embodiments of the present invention numerous additional advantages. By way of example, the present invention has the desirable attributes of an articulated connection between the blast tuyere and blast nozzle while at the same time actually having a rigid interconnection of the nozzle to the blast tuyere. Additionally, both embodiments of the present invention permit the refractory lining 21 of the blast nozzle 1 to be extended, by means of a refractory lining 23, over a considerable length of the blast tuyere 9. Accordingly, the coolant circulting in portion 13 of the blast tuyere 9, which functions to cool the portion of the injection nozzle projecting into the furnace, does not have any appreciable cooling effect on the preheated gases passing into the furnace through the blast tuyere. Accordingly, the present invention has a positive effect on the thermal balance of the insufflated hot gas and also on the efficiency of the cooling of the blast tuyere.

The flexible mounting of the rigidized unitary blast nozzle 1/blast tuyere 9 assembly onto the tuyere arc cooler 17 allows a more efficient cooling of the hinged connection since the components directly subjected to the circulating fluid coolant are not subjected to the heated gas being injected into the furnace. Also, as noted above, the blast tuyere 9 is more efficiently cooled because of its refractory lining 23. Thus, heat shocks on the connection zone are attenuated and the risk of premature wear avoided.

An additional advantage resides in the possibility of providing a sealing ring, such as O-ring 25 of FIGS. 2 and 3, in a groove provided in the hinged connection between the blast nozzle/blast tuyere assembly and the arc cooler. The possibility of employing an O-ring seal is precipitated by the fact that the seat or connection region is, when compared to the prior art, located in comparatively cool zone.

As will now be obvious to those skilled in the art, an important feature of the present invention is the straight and fixed alignment of the blast nozzle and the blast tuyere and of their respective refractory linings 23 and 21. This arrangement of parts secures a linear and undisturbed flow of the heated gas being delivered to the furnace. Also, as will be obvious from FIG. 1, in accordance with the present invention it is possible to simultaneously withdraw, in a single step, the blast nozzle and the blast tuyere in order ot perfrom any necessary maintenance thereto. Considering further the refractory linings 23 and 21, as indicated in the drawings the linings typically will be separately applied to their respective supporting members. After the blast nozzle and blast tuyere have been assembled, continuity of the lining is achieved by grouting the joint. It is, of course, possible to manufacture the refractory lining as a single piece.

As an additional advantage provided by the present invention, the conduits through which the liquid coolant is delivered to the blast tuyere may be rigid since there is no relative movement between the blast nozzle 1 and the blast tuyere 9. The conduits, such as conduit 15, may thus be mounted by means of a clamp 35 fixed to the outer surface of the blast nozzle 1 in such a manner that a sliding support is established. This is a much simpler mounting arrangement that has characterized the prior art. Also, since the blast nozzle is neither guided in the tuyere block 7 nor the tuyere arc cooler 17, space is provided for and accordingly it is relatively easy to provide an adequate number of inlet and outlet conduits for coolant; such conduits being supported on the blast nozzle 1 in the vicinity of the tuyere stock bend. Such an arrangement simplifies the connection of the coolant supply and facilitates removal, as a unit, of that portion of the tuyere stock defined by the bend 41, blast nozzle 1 and blast tuyere.

The articulated connection of the rigid unitary blast nozzle/blast tuyere assembly to the tuyere arc cooler, and especially the conicity of 50°–60° of the seat between the elements, facilitates the withdrawal of the blast tuyere as it will generally be unnecessary to dislodge the blast tuyere from its seat by means of jolt-ramming or hammer machines. Thus, should repair or replacement of a blast tuyere be required, replacement of components can be accomplished rapidly and shut-down periods of the furnace are considerably abridged.

A further advantage of the present invention resides in the fact that all of the cooling water connections to the blast tuyere can be made and tested in the shop on the assembly comprising unit bend 41, blast nozzle 1 and blast tuyere 9.

Returning again briefly to a consideration of FIG. 1, the other elements of the tuyere stock are arranged in the usual manner as taught in U.S. Pat. No. 3,662,696. Thus, the remainder of the tuyere stock comprises the bend section 41 and the linear conduit sections 43, 45 and 47 which are lined with refractory material 50. The upstream conduit section 47 is connected to the hot-blast main supply pipe 49. Articulations are provided between the individual elements 47–45 and 45–43; these articulations being indicated at 53 and 51 and being shown in FIG. 1 as comprising Cardan compensators. It is, however, in accordance with the present invention possible to provide ball and socket joints or other devices in place of the coupling mechanisms 51 and 53 shown. Thus, a particular advantage of the present invention resides in the fact that it is not limited to use with any particular type of tuyere stock and may be combined with all known tuyere stock devices.

To conclude a description of the elements depicted in FIG. 1 and not previously described, an inspection hole 55 with a plug 57 is, in the usual manner, provided in the bend section 41 of the tuyere stock. To facilitate the removal of the unitary blast nozzle/blast tuyere assembly, the lowermost linear pipe element 43 is interconnected with the bend section 41 by means of horizontal flanges 59 and 61.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In apparatus for delivering preheated fluid from a source for injection into a furnace, the improvement comprising:

fluid injector means, said injector means defining a first conduit section having first and second ends and being adapted to be at least partly inserted into a furnace combustion chamber through an aperture in the furance wall whereby fluid may be discharged into the furnace from said first end of said first conduit section;

a lining of refractory material on at least a portion of the wall of said fluid injector means, said refractory material extending longitudinally from said second end of said first conduit section toward said first end and defining the inner diameter of said portion of said first conduit section;

nozzle means, said nozzle means defining a second conduit section, said nozzle means including a lining of refractory material which defines the inner diameter of said second conduit section;

means rigidly assembling said injector means to said nozzle means whereby said first and second conduit sections are axially aligned and said lining of refractory material on said nozzle means and said lining of refractory material on said fluid injector means cooperate to form a continuous lining and define a fluid passage with a substantially continuous straight wall; and cooler means, said cooler means being installed in the furnace wall about said rigidly assembled injector means and nozzle means, a portion of said cooler means cooperating with said rigidly assembled injector and nozzle means to define a pivot connection therebetween whereby distortions of the delivering apparatus may be accommodated without interruption of the connection established between said cooler means and said rigidly assembled injector and nozzle means.

2. The apparatus of claim 1 wherein said cooler means comprises:

a jacket through which a coolant may be circulated, the wall of said jacket facing said injector-nozzle means assembly being provided with an arcuate portion which extends generally inwardly toward the axis of the conduit defined by said injector-nozzle means assembly.

3. The apparatus of claim 2 wherein said injector means includes a ring member which extends radially outwardly toward said cooler means, said ring member having a peripheral surface complimentary in shape to said cooler means arcuate wall portion whereby an articulated coupling between the injector-nozzle means assembly and said cooler means is formed by intervention of said injector means ring member.

4. The apparatus of claim 3 wherein said injector means ring member defines a spherical seat at its periphery for cooperation with said cooler means arcuate wall portion.

5. The apparatus of claim 4 wherein the conicity of the spherical zone of said seat is in the range of 50° to 60°.

6. The apparatus of claim 3 wherein said injector means includes a ring member which extends radially outwardly toward said cooler means, said ring member having a peripheral surface complementary in shape to said cooler means arcuate wall portion whereby an articulated coupling between the injector-nozzle means assembly and said cooler means is formed by intervention of said injector means ring member.

7. The apparatus of claim 6 wherein said injector means ring member defines a spherical seat at its periphery for cooperation with said cooler means arcuate wall portion.

8. The apparatus of claim 7 further comprising: resilient sealing means mounted in said injector means ring member peripheral surface.

9. The apparatus of claim 3 wherein said nozzle means includes a radially outwardly extending flange, the peripheral surface of said flange being complementary in shape to said cooler means arcuate wall portion whereby an articulated coupling between the injector-nozzle means assembly and said cooler means is formed by intervention of said nozzle means flange.

10. The apparatus of claim 9 wherein said nozzle means flange defines a spherical seat at its periphery for cooperation with said cooler arcuate wall portion.

11. The apparatus of claim 10 further comprising: resilient sealing means mounted in said nozzle means flange peripheral surface.

12. The apparatus of claim 2 wherein said nozzle means includes a radially outwardly extending flange, the peripheral surface of said flange being complimentary in shape to said cooler means arcuate wall portion whereby an articulated coupling between the injector-nozzle means assembly and said cooler means is formed by intervention of said nozzle means flange.

13. The apparatus of claim 12 wherein said nozzle means flange defines a spherical seat at its periphery for cooperation with said cooler arcuate wall portion.

14. The apparatus of claim 13 wherein the conicity of the spherical zone of said seat is in the range of 50° to 60°.

* * * * *